US006779529B2

(12) United States Patent
Figlar et al.

(10) Patent No.: US 6,779,529 B2
(45) Date of Patent: Aug. 24, 2004

(54) CIGARETTE FILTER

(75) Inventors: James N. Figlar, Macon, GA (US); Brian E. Tucker, Macon, GA (US); F. Kelley St. Charles, Perry, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 10/178,713

(22) Filed: Jun. 24, 2002

(65) Prior Publication Data

US 2003/0070686 A1 Apr. 17, 2003

Related U.S. Application Data

(60) Provisional application No. 60/309,435, filed on Aug. 1, 2001.

(51) Int. Cl.[7] ..... A24B 15/18

(52) U.S. Cl. ..... 131/334; 131/341; 131/331; 131/342; 131/343; 131/344

(58) Field of Search ..... 313/334, 341, 313/331, 342, 343, 344

(56) References Cited

U.S. PATENT DOCUMENTS

| | | | | |
|---|---|---|---|---|
| 2,815,760 A | | 12/1957 | Schreus et al. | |
| 2,915,069 A | | 12/1959 | Schur | |
| 3,266,973 A | | 8/1966 | Crowley | |
| 3,658,069 A | | 4/1972 | Wise et al. | |
| 3,716,500 A | * | 2/1973 | Litzinger | 521/29 |
| 3,828,800 A | | 8/1974 | Litzinger | |
| 3,841,338 A | | 10/1974 | Horsewell et al. | |
| 3,960,770 A | | 6/1976 | Raley, Jr. et al. | |
| 3,998,988 A | | 12/1976 | Shimomai et al. | |
| 4,003,257 A | | 1/1977 | Fletcher et al. | |
| 4,033,361 A | | 7/1977 | Horsewell et al. | |
| 4,063,912 A | | 12/1977 | Neely et al. | |
| 4,149,550 A | | 4/1979 | Green et al. | |
| 4,195,649 A | | 4/1980 | Noguchi et al. | |
| 4,246,910 A | | 1/1981 | Rainer et al. | |
| 4,266,561 A | | 5/1981 | Litzinger | |
| 4,300,577 A | | 11/1981 | Horsewell et al. | |
| 4,438,196 A | | 3/1984 | Lantero, Jr. | |
| 4,466,906 A | | 8/1984 | Marty et al. | |
| 4,531,953 A | | 7/1985 | Groose et al. | |
| 4,700,723 A | | 10/1987 | Yoshikawa et al. | |
| 5,060,672 A | | 10/1991 | Irimi et al. | |
| 5,104,530 A | | 4/1992 | Maroldo et al. | |
| 5,228,962 A | | 7/1993 | Mani et al. | |
| 5,271,419 A | | 12/1993 | Arzonico et al. | |
| 5,271,780 A | | 12/1993 | Baigas, Jr. | |
| 5,281,257 A | | 1/1994 | Harris | |
| 5,319,114 A | | 6/1994 | Gaffney et al. | |
| 5,385,876 A | | 1/1995 | Schwarz et al. | |
| 5,409,021 A | | 4/1995 | Safaev et al. | |
| 5,423,336 A | | 6/1995 | Mentzel et al. | |
| 5,575,302 A | | 11/1996 | Blocker et al. | |
| 6,117,328 A | | 9/2000 | Sikdar et al. | |
| 6,119,699 A | | 9/2000 | Sung | |
| 6,257,242 B1 | | 7/2001 | Stavridis | |

* cited by examiner

*Primary Examiner*—Dionne A. Walls
(74) *Attorney, Agent, or Firm*—Charles G. Lamb; John F. Salazar; Middleton Reutlinger

(57) ABSTRACT

A cigarette filter includes a multiple section filter which reduces the level of predetermined smoke constituents. The filter includes a fibrous filter plug section, a selective adsorbent section, and a general adsorbent section co-axially aligned in tandem. The selective adsorbent section includes a selective absorbent material which is a phenol-formaldehyde resin matrix surface-functionalized with mainly primary and secondary amine functional groups which removes specific smoke constituents from the tobacco smoke. The general adsorbent section is a material capable of adsorbing a range of chemical compounds without a high degree of specificity.

10 Claims, 2 Drawing Sheets

CIGARETTE FILTER

CROSS-REFERENCE TO RELATED PATENT APPLICATIONS

This application claims priority from U.S. Provisional Application Ser. No. 60/309,435, filed Aug. 1, 2001, which application is incorporated herein by reference in its entirety.

BACKGROUND

The present invention relates to a cigarette filter that includes a smoke constituent adsorbent which, when combined with a carbon-based filtering material, demonstrates synergistic reductions in smoke vapor constituents.

Cigarettes include tobacco rods or columns which, when burned, produce a particulate and a vapor phase. About 70 years ago, filters began to be attached to an end of the tobacco column. Among other things, the filter removed various smoke components. Filters made from filamentary or fibrous material, such as cellulose acetate tow or paper, remove the particulate phase of tobacco smoke by mechanical means. However, the fibrous materials are not effective at removing volatile constituents, such as aldehydes, hydrogen cyanide and sulfides, which are found in the vapor phase. Typically, an adsorbent or absorbent is combined with the fibrous material to improve removal of the vapor phase components. For example, cigarette filters have included activated carbon, porous minerals such as meerschaum, silica gel, cation-exchange resins and anion-exchange resins.

Charcoal has a high specific surface area and is a relatively strong adsorbent for vapor-phase constituents of tobacco smoke. When coated with a mixture of metallic oxides, charcoal is particularly effective in removing acidic gases. Meerschaum has a large adsorption area with a strong adsorption affinity for charged species, but a considerably low adsorption affinity for non-polar species. Silica gels are generally regarded as weakly retentive adsorbents for vapor-phase constituents of tobacco smoke. Although silica gel readily adsorbs aldehydes and hydrogen cyanide, the constituents also readily desorb from the silica gel. Cation exchange resins have been proposed for nicotine removal. Anion exchange resins have been proposed for the removal of smoke acids, but strongly basic anion exchangers have no effect on smoke vapor phase aldehydes. Weakly basic anion-exchange resins of porous structure are suitable for the removal of smoke acids and aldehydes, but their efficiency diminishes during smoking, as does that of carbon and porous minerals.

Two or more adsorbents can be used in combination in cigarette filters. For example, U.S. Pat. No. 2,815,760 describes the use of an ion exchange material with materials which "chemically react with the harmful, nonalkaline and nonacid components of the smoke to form non-volatile compounds, thus retaining the latter to the filter." However, the aforesaid additives have not yielded satisfactory selective removal of such smoke phase components, as smoke aldehydes, particularly acetaldehyde and acrolein. U.S. Pat. No. 4,300,577 describes the use of a weakly retentive absorbent for vapor-phase constituents intermingled with a second component having mainly primary amino functional groups for the removal of vapor-phase constituents, including aldehydes and hydrogen cyanide from tobacco smoke. However, the filter of the '577 patent has not been shown to demonstrate adequate consumer acceptance or commercial viability.

SUMMARY

The present invention relates to a cigarette filter that includes a multiple section filter which reduces the level of predetermined smoke constituents. The filter consists of a fibrous filter plug located at the mouth-end of the cigarette, a section containing a selective adsorbent material, and a section containing a general adsorbent material.

The filter plug can be any filter plug known in the art, such as cellulose acetate tow. The general adsorbent material is preferably selected from a group of relatively high surface area materials, such as activated charcoal, which are capable of adsorbing a range of chemical compounds without a high degree of specificity. The selective adsorbent material is chosen based on the specific smoke constituents targeted for removal. Preferably, the selective adsorbent material is selected from a group of surface functionalized resins, wherein each resin consists of an essentially inert carrier with a surface area of greater than about 35 $m^2/g$. In an embodiment of the present invention, the selective adsorbent material has a phenol-formaldehyde resin matrix surface-functionalized with mainly primary and secondary amine functional groups.

Structurally, the selective adsorbent material may be positioned adjacent to a tobacco rod and the general adsorbent material positioned between the selective adsorbent section and the filter plug. Alternatively, the general adsorbent material may be positioned adjacent to the tobacco rod and the selective adsorbent material positioned between the general adsorbent section and the filter plug. Preliminary data indicates that the former orientation produces a synergistic effect in smoke constituent reductions relative to the latter orientation. Further, the selective adsorbent and general adsorbent may be interspersed in a traditional filter plug material, such as cellulose acetate, or the adsorbents may be packed as a bed or thin layer sections within filter plug material.

DETAILED DESCRIPTION

The cigarette filter of the present invention includes a multiple section filter which reduces the levels of predetermined smoke constituents. The filter consists of a fibrous filter plug located at the mouth-end of the cigarette, a section containing a selective adsorbent material, and a section containing a general adsorbent material.

Figure 1:
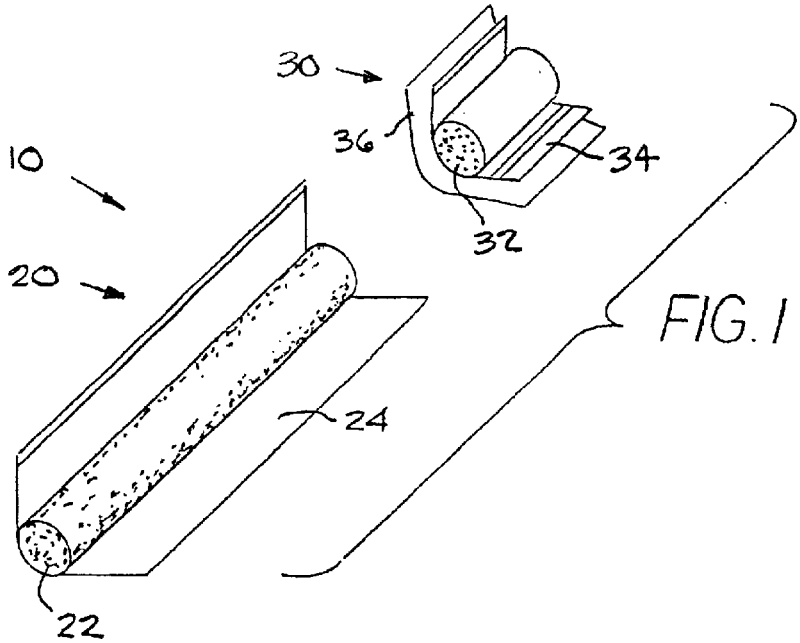
FIG. 1 is a perspective view of a prior art filter-tipped cigarette.

As shown in FIG. 1 and as is known in the art, a typical filter-tipped cigarette 10 has a filter 30 attached to a tobacco rod 20. The tobacco rod 20 consists of a loose tobacco-containing mixture 22 wrapped in a cigarette paper 24, and the filter 30 includes a filter plug 32 wrapped in a plug wrap 34. A sheet of tipping paper 36 joins the filter 30 to the tobacco rod 20.

Figure 2:
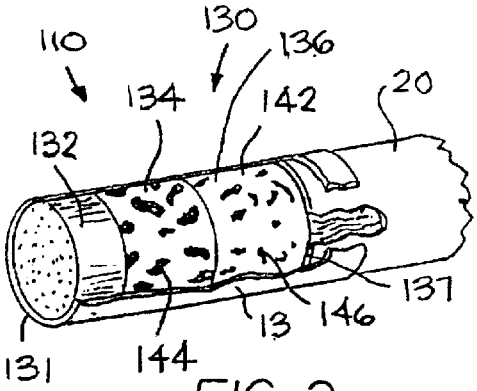
FIG. 2 is a perspective view of a filter for a cigarette made in accordance with the present invention wherein the adsorbents are dispersed throughout a filter plug material, and the general adsorbent section is positioned between the filter plug and the selective adsorbent section.

In the present invention, as shown in FIG. 2, a cigarette 110 has a multiple section filter 130 attached to the tobacco rod 20. As shown in FIG. 2, the filter 130 includes a filter plug 132, a section containing a general adsorbent 134 and a section containing a selective adsorbent 136. The filter plug 132 is adjacent a first or mouth end 131 of the filter 130. The bed of the selective adsorbent 136 is adjacent a second or tobacco-rod end 137 of the filter 130. The bed of the general adsorbent 134 is positioned between the filter plug 132 and the selective adsorbent bed 136.

The filter plug 132 is made from a filamentary or fibrous material and provides a clean, neat appearance at the mouth end 131 of the cigarette. The filter plug 132 also retains a firmness at the mouth end 131 as the cigarette 110 is consumed. As is known in the art, the filter plug 132 can be made from a variety of materials, among the most common being cellulose, cellulose acetate tow, paper, cotton, polypropylene web, polypropylene tow, polyester web, polyester tow or combinations thereof. Optionally, a plasticizer may be included. Further, the filter plug 132 may carry liquid additives or flavoring agents. Functionally, the filter plug 132 may capture some particulate matter from the tobacco smoke as the cigarette 110 is burned.

The general adsorbent section 134 includes a general adsorbent material 144 dispersed throughout a filter plug material 142, such as in a "dual-dalmatian" filter, known in the art. The general adsorbent material 144 is preferably selected from a group of relatively high surface area materials which are capable of adsorbing smoke constituents without a high degree of specificity. For example, activated charcoal, activated coconut carbon, activated coal-based carbon, zeolite, silica gel, meerschaum, aluminum oxide or combinations thereof are among the more common general adsorbents known in the art. Other general adsorbents which may be used include a coal-based carbon made from semi-anthracite coal with a density about 50% greater than coconut-based charcoal (available from Calgon Carbon, Pittsburgh, Pa.), a carbonaceous resin derived from the pyrolysis of sulfonated styrene-divinylbenzene, such as Ambersorb 572 or Ambersorb 563 (available from Rohm and Haas, 5000 Richmond Street, Philadelphia, Pa. 19137), other materials having similar particle sizes, surface area, and binding affinities, or combinations thereof. To further enhance the efficacy of the general adsorbent, metal oxides or other metal-based complexes may optionally be included in the general adsorbent section.

The selective adsorbent section 136 includes a selective adsorbent material 146 dispersed throughout a filter plug material 142, such as in a "dual-dalmatian" filter, known in the art. The selective adsorbent material 146 is preferably selected based on the material's 146 specificity for a predetermined class of chemical compounds. For example, the selective adsorbent material 146 may be an ion-exchange resin, such as Duolite A7 (available from Rohm and Haas, 5000 Richmond Street, Philadelphia, Pa. 19137), or a material having similar functional groups and binding affinities. The Duolite A7 has a phenol-formaldehyde resin matrix and is surface-functionalized with primary and secondary amino groups, thereby enhancing the resin's specificity toward the aldehydes and hydrogen cyanide found in tobacco smoke.

Further, the selective adsorbent material 146 must be selected taking into consideration that the contact conditions between the tobacco smoke and the adsorbent 146 are dependent on a number of variables, including how strongly the smoker pulls the smoke through the filter as the cigarette is being smoked and how much of the tobacco rod has been consumed prior to each puff. Thus, it is advantageous that the selective adsorbent 146 have a surface area of greater than about 35 $m^2/g$ so that there is minimal diffusional resistance and the surface area functional sites are easily accessible. Materials with greater surface areas also demonstrate less noticeable performance decline if part of the surface is covered with a plasticizer, as might occur when the adsorbent 146 is dispersed in the filter plug 142.

When the cigarette is consumed, the tobacco smoke is puffed by the smoker through the filter 130. The smoke initially passes over the selective adsorbent section 136 where the targeted smoke constituents are adsorbed on the surface of the selective adsorbent material 146 and particulate matter in the smoke is retained by the filter plug material 142. The remaining smoke then passes over the general adsorbent section 134 where other constituents may be retained by the adsorbent material 144 and additional particulate matter is retained by the filter plug material 142. Finally, the remaining smoke then passes through the filter plug 132 where additional particulate matter can be removed. The filtered smoke is then delivered to the smoker.

In a first example embodiment of the present invention, as shown in FIG. 2, the multiple section filter 110 is made having a filter plug 132 made of cellulose acetate tow and being about 7 mm in length, and having a general adsorbent section 134 consisting of 40 mg of activated coconut charcoal 144 dispersed throughout cellulose acetate tow 142 cut to deliver a section 134 about 10 mm in length wherein the cellulose acetate tow is treated with a plasticizer, and having a selective adsorbent section 136 consisting of 40 mg of Duolite A7 dispersed throughout cellulose acetate tow 142 cut to deliver a section 136 about 10 mm in length wherein the cellulose acetate tow is treated with a plasticizer. When the tobacco rod is burned with a normal puff/rest cycle, analysis of the smoke vapor exiting at the mouth end 131 of the cigarette 110 shows statistically significant reductions in the levels of hydrogen cyanide, furan, propionaldehyde, acetone, methyl ethyl ketone/butyraldehyde, hydrogen sulfide, 1,3-butadiene, 2-methylpropanal, isoprene, styrene, pyridine, toluene and benzene as compared to cigarettes using similar resin-only filters. When the tobacco rod is burned with a normal puff/rest cycle, analysis of the smoke vapor exiting at the mouth end 131 of the cigarette 110 shows statistically significant reductions in the levels of pyridine, hydrogen cyanide, hydrogen sulfide, styrene, 2-methylpropanal, benzene, propionaldehyde, furan, isoprene, 1,3-butadiene, crotonaldehyde, acetone, acrylonitrile, acetaldehyde, toluene, carbon disulfide, methyl ethyl ketone/butyraldehyde, propionaldehyde, acetonitrile, and methanol as compared to cigarettes using charcoal-only filters.

As shown in FIG. 2, the multiple section filter 130 has the filter plug 132 adjacent the mouth end 131, the selective adsorbent section 136 adjacent the tobacco-rod end 137, and the general adsorbent section 134 positioned between the filter plug 132 and the selective adsorbent section 136.

Figure 3:
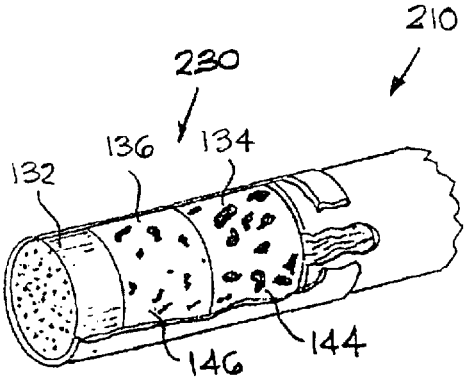
FIG. 3 is a perspective view of a filter for a cigarette made in accordance with the present invention wherein the adsorbents are dispersed throughout a filter plug material, and the selective adsorbent section is positioned between the filter plug and the general adsorbent section.

Alternatively, as shown in FIG. 3, a cigarette 210 has a multiple section filter 230 wherein the filter plug 132 is positioned at the mouth end 131, the general adsorbent section 134 is adjacent the tobacco-rod end 137, and the selective adsorbent section 136 is sandwiched between the filter plug 132 and the general adsorbent section 134. With the alternative relative positioning of the general adsorbent section 134 and selective adsorbent section 136, during a normal puff, the smoke first passes through the general adsorbent section 134, then through the selective adsorbent section 136, and finally through the filter plug 132.

In a second example embodiment of the present invention, a cigarette 210 includes a multiple section filter 230 (FIG. 3) which is essentially identical to the filter 130 (FIG. 2) of the first example embodiment except that the general adsorbent section 134 is adjacent to the tobacco rod 20 and the selective adsorbent section 136 is sandwiched between the filter plug 132 and the general adsorbent section 134. When the tobacco rod is burned with a normal puff/rest cycle, analysis of the smoke vapor exiting at the mouth end 131 of the cigarette 210 (FIG. 3) shows statistically significant reductions in the levels of propionaldehyde, acetone, methyl ethyl ketone/butyraldehyde, crotonaldehyde, hydrogen sulfide, 2-methylpropanal, pyridine, acrolein, toluene, acetaldehyde, acrylonitrile, methanol and benzene as compared to cigarettes using similar resin-only filters. When the tobacco rod is burned with a normal puff/rest cycle, analysis of the smoke vapor exiting at the mouth end 131 of the cigarette 210 shows statistically significant reductions in the levels of pyridine, hydrogen cyanide, benzene, propionitrile, crotonaldehyde, acetone, acrylonitrile, acetaldehyde, toluene, carbon disulfide, methyl ethyl ketone/butyraldehyde, propionaldehyde, acetonitrile, and methanol as compared to cigarettes using charcoal-only filters.

In the configuration shown in FIG. 2, the smoke passes over the selective adsorbent material 146 before passing over the general adsorbent 144. This allows the selective adsorbent 146 to remove some specific smoke constituents before the general adsorbent 144 is exposed to the smoke, thereby allowing the general adsorbent 144 to be more effective in removing the remaining smoke constituents. For example, the cellulose acetate/charcoal/Duolite A7 filter 130 of the first embodiment is more effective at removing hydrogen cyanide, methanol, crotonaldehyde, acrolein, acetaldehyde, propionaldehyde, acetonitrile, methyl ethyl ketone, hydrogen sulfide, propionitrile, acetone, 2-methylpropanal, benzene, toluene, isoprene, furan, acrylonitrile, 1,3-butadiene, and carbon disulfide than the cellulose acetate/Duolite A7/charcoal filter 230 of the second embodiment.

Figure 4:
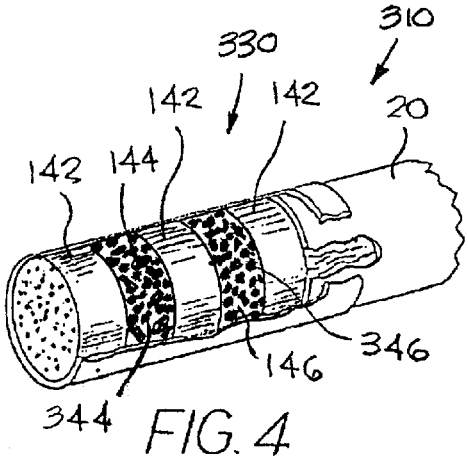
FIG. 4 is a perspective view of a filter for a cigarette made in accordance with the present invention wherein the adsorbents are packed as beds with in a segment of a filter plug material.
Figure 7:
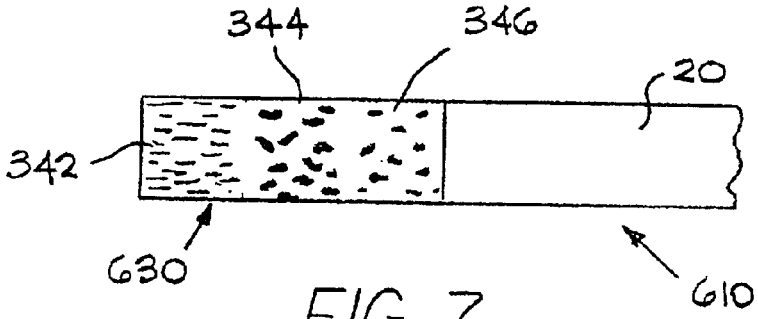
FIG. 7 is a cross-sectional view of an embodiment of the present invention with the absorbents being sectionalized in a single length of fibrous filter material; and, FIG. 8 is a cross-sectional view of an embodiment of the present invention absent a filter plug section.

From a production perspective, there are some advantages to dispersing the selective adsorbent material 146 and the general adsorbent material 144 throughout the filter tow 142. Specifically, when the adsorbents 144, 146 are dispersed within the tow 142, the adsorbents are easier to handle than they are as loose particles. However, when the adsorbents 144, 146 are dispersed within the tow 142, there is a risk that any plasticizer which is used on the tow 142 will affect the surface of the adsorbents 144, 146, thereby reducing the adsorption capacity. Thus, as shown in FIG. 4, in a multiple section filter 330 of a cigarette 310, the adsorbents 144, 146 may be packed within the filter plug material 142 as thin layer sections of general adsorbent 344 and selective adsorbent 346. Because the layer packed adsorbents would not be exposed to the same level of plasticizer as the tow-dispersed adsorbents, the adsorbents would retain more available surface area for interacting with smoke constituents. Moreover, as shown in FIG. 7, a multi-section filter 630 for a cigarette 610 includes the general adsorbent 344 and the selective adsorbents 346 dispersed in separate sections within a single length of fibrous filter material 342.

Figure 5:
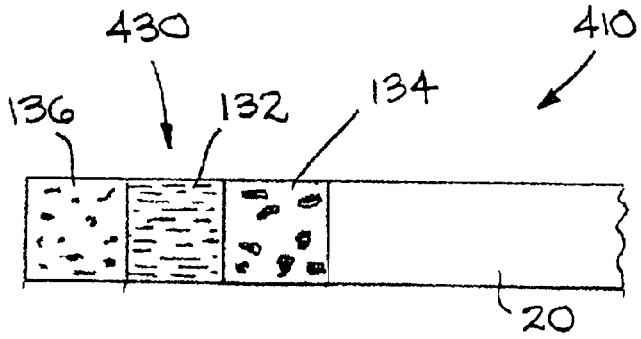
FIG. 5 is a cross-sectional view of an embodiment of the present invention with the filter plug disposed between the general adsorbent section and the selective adsorbent section.
Figure 6:
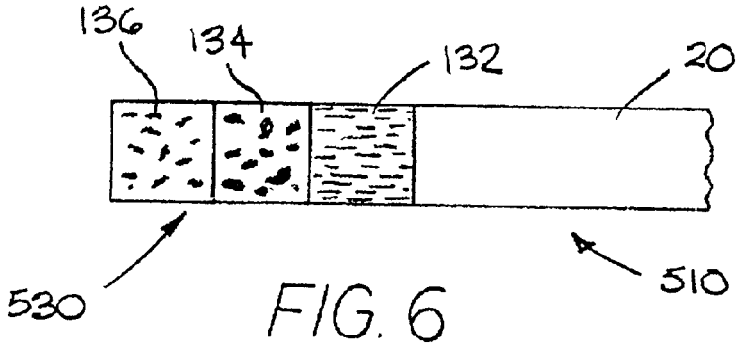
FIG. 6 is a cross-sectional view of an embodiment of the present invention with the filter plug adjacent to one end of a tobacco rod.
Figure 8:
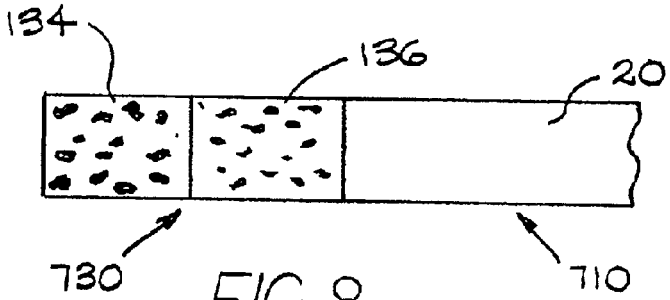

As shown in FIGS. 5 and 6, in a multiple section filter 430 and 530 of cigarettes 410 and 510, respectively, the filter plug 132 is disposed between the general adsorbent section 134 and the selective adsorbent section 136 in FIG. 5 and is adjacent one end of the tobacco rod 20 in FIG. 6. In FIG. 5 the selective adsorbent section 136 is at the mouth end of the filter 430 and in FIG. 6, the general adsorbent section 134 is at the mouth end of the filter 530. Moreover, as shown in FIG. 8, a multiple section filter 730 of a cigarette 710 includes only a general absorbent section 134 and a selective absorbent section 136.

From a reading of the above, one with ordinary skill in the art should be able to devise variations to the inventive features. For example, the filter plug, the general adsorbent section, and the selective adsorbent section may vary in length and diameter, relative to any dimensions specified herein and relative to each other. Further, the various section dimensions may be optimized for a particular tobacco blend or for particular tobacco rod dimensions. These and other variations are believed to fall within the spirit and scope of the attached claims.

What is claimed is:

1. A multiple section cigarette filter comprising:

(a) a selective adsorbent section comprising a selective adsorbent material which is an ion-exchange resin having an affinity for a predetermined class of chemical compounds dispersed throughout a fibrous material, said ion-exchange resin being a phenol-formaldehyde resin matrix and is surface-functionalized with primary and secondary amine groups;

(b) a general adsorbent section comprising a general adsorbent material having a high surface area and being capable of adsorbing smoke constituents without a high degree of specificity, said general adsorbent material being selected from the group consisting of activated charcoal, activated coconut carbon, activated coal-based carbon, zeolite, silica gel, meerschaum, aluminum oxide, a coal-based charcoal made from semi-anthracite coal, a carbonaceous resin derived from the pyrolysis of sulfonated styrene-divinylbenzene, or combinations thereof; and (c) a filter plug, said general adsorbent section being axially aligned in tandem between said filter plug and said selective adsorbent section.

2. The cigarette falter of claim 1 wherein said general adsorbent section comprises said general adsorbent material dispersed throughout a fibrous material.

3. The cigarette filter of claim 1 wherein said general adsorbent section comprises a dose-packed bed of said general adsorbent material.

4. The cigarette filter of claim 1 wherein said general adsorbent section further includes a metal oxide or other metal-based complex.

5. The cigarette filter of claim 1, said filter plug being a fibrous filter plug made from cellulose, cellulose acetate tow, paper, cotton, polypropylene web, polypropylene tow, polyester web, polyester tow or a combination thereof.

6. The cigarette filter of claim 5 wherein said filter plug further includes a plasticizer, a liquid additive, a flavoring agent or a combination thereof.

7. The cigarette filter of claim 1, said selective absorbent material having a surface area greater than about 35 $m^2/g$.

8. A cigarette filter comprising:

(a) a preselected length of fibrous material;

(b) a selective adsorbent material dispersed throughout a first preselected selection along said preselected length, said selective absorbent material having an affinity for a predetermined class of chemical compounds dispersed throughout a fibrous material, said selective adsorbent material being an ion-exchange resin, said ion-exchange resin being a phenol formaldehyde resin matrix end is surface-functionalized with primary and secondary amine groups; and (c) a general adsorbent material selected from the group consisting of activated charcoal, activated coconut carbon, activated coal-based carbon, zeolite, silica gel, meerschaum, aluminum oxide, a coal-based charcoal made from semi-anthracite coal, a carbonaceous resin derived from the pyrolysis of sulfonated styrene-divinylbenzene, or combinations thereof, dispersed throughout a second preselected section along said preselected length, said general adsorbent material having a high surface area end being capable of adsorbing smoke constituents without a high degree of specificity, said general adsorbent section being axially aligned in tandem between said fibrous material and said selective adsorbent section.

9. The cigarette filter of claim 8 wherein said general adsorbent material further includes a metal oxide or other metal-based complex.

10. The cigarette filter of claim 8 wherein said fibrous material includes a plasticizer, a liquid additive, a flavoring agent or a combination thereof.

* * * * *